United States Patent [19]

Wahle et al.

[11] 4,009,722

[45] Mar. 1, 1977

[54] METHOD AND MACHINE FOR MAKING CIGARETTES WITH COMPOSITE FILLERS

[75] Inventors: Günter Wahle, Reinbeck; Rolf Dahlgrün, Tornesch; Dieter Ludszeweit, Hamburg, all of Germany

[73] Assignee: Hauni-Werke Korber & Co., KG, Hamburg, Germany

[22] Filed: Sept. 11, 1975

[21] Appl. No.: 612,584

[30] Foreign Application Priority Data

Sept. 26, 1974 Germany ..... 2445856

[52] U.S. Cl. ..... 131/39; 131/84 C; 131/110

[51] Int. Cl.[2] ..... A24C 5/18

[58] Field of Search ..... 131/65, 38, 39, 110, 131/188, 261 B, 265, 267, 84 R, 84 C

[56] References Cited

UNITED STATES PATENTS

| | | | |
|---|---|---|---|
| 2,926,671 | 3/1960 | Carlson | 131/39 X |
| 3,736,941 | 6/1973 | Molins et al. | 131/84 C |
| 3,779,252 | 12/1973 | Brackmann et al. | 131/110 X |
| 3,795,249 | 3/1974 | Cristiani | 131/84 C |

*Primary Examiner*—Stephen C. Pellegrino
*Attorney, Agent, or Firm*—Peter K. Kontler; John Kurucz

[57] ABSTRACT

Cigarettes with composite fillers wherein the mouthpiece consists of first tobacco shreds having a low nicotine content and the major portion of the filler consists of second shreds having a higher nicotine content are manufactured by showering second shreds onto a narrow band conveyor to form a continuous stream, by depositing batches of first shreds on the band conveyor at regular intervals so that the batches overlie the adjacent portions of the first stream or vice versa, by trimming the thus obtained composite stream so as to remove second shreds in the region of the batches whereby the resulting filler contains batches of first shreds alternating with filler portions consisting of second shreds, wrapping the filler into a web of cigarette paper, and severing the resulting rod across or adjacent to the batches.

18 Claims, 3 Drawing Figures

METHOD AND MACHINE FOR MAKING CIGARETTES WITH COMPOSITE FILLERS

BACKGROUND OF THE INVENTION

The present invention relates to a method and machine for making cigarettes, cigars, cigarillos or analogous rod-shaped smokers' products, and more particularly to a method and machine for making rod-shaped smokers' products (hereinafter called cigarettes for short) of the type wherein a tubular wrapper of cigarette paper or the like surrounds a composite rod-like tobacco filler. Still more particularly, the invention relates to improvements in a method and machine for the manufacture of cigarettes containing several types of natural tobacco or natural tobacco plus other material, such as reconstituted tobacco, a particulate fibrous filler material or another substitute for tobacco.

It is known to manufacture cigarettes, cigars or cigarillos in such a way that the rod-like filler consists of two types of tobacco. Thus, in certain types of presently known cigarettes, the major portion of the rod-like filler consists of tobacco shreds having a relatively high nicotine content and the minor portion of the filler consists of tobacco shreds having a lower nicotine content or of a substitute for tobacco. The minor portion then constitutes a filter plug, i.e., it is placed into the mount and the smoker lights the free end of the major portion of the filler. It is desirable to establish a clear-cut line of demarcation or boundary between the major and minor portions of the rod-like filler (as considered in the axial direction of the cigarette) and to further insure that the boundary is located at a predetermined distance from both ends in each of a series of mass-produced cigarettes.

A drawback of presently known methods and machines for the production of just described cigarettes having composite fillers is that the output is low and that the cigarettes cannot be manufactured with a desired degree of reproducibility (especially as regards the locus of the boundary between the two portions of the filler). Attempts to mass-produce cigarettes of the just described type include the provision of a machine which produces a rod-like filler consisting of overlapping portions having tobacco shreds of different types, i.e., the filler portion having shreds of one type is not placed end-to-end with the filler portion having tobacco shreds of another type. The arrangement is such that the ratio of one type of tobacco shreds to the other type of tobacco shreds varies, as considered in the axial direction of the filler. Reference may be had to German Offenlegungsschrift No. 2,259,814. This publication discloses a machine having means for producing a continuous tobacco stream consisting of tobacco shreds of a first type, means for forming wedge-like cutouts in the stream, and means for inserting tobacco shreds of a second type into successive cutouts to form a composite stream which is thereupon trimmed and wrapped into cigarette paper or the like. Thus, filler portions which contain shreds of the first type taper in the axial direction of the filler, the same as the filler portions containing shreds of the second type. Such machine exhibits the drawback that the smoker is likely to inhale smoke which develops during simultaneous combustion of both types of tobacco shreds. Moreover, then the composite stream is trimmed, the removed surplus contains a mixture of both tobacco types so that the surplus cannot be returned into the magazine for tobacco shreds of the first or second type. Consequently, the operation is wasteful and the smoker is likely to inhale smoke produced on combustion of low-quality tobacco or a substitute therefor.

SUMMARY OF THE INVENTION

An object of the invention is to provide a novel and improved method of making cigarettes, cigars, cigarillos or analogous rod-shaped smokers' products wherein the filler contains two different types of particulate fibrous material and the filler portions consisting of such different types of fibrous material are arranged end-to-end.

Another object of the invention is to provide a method according to which all of the material which is removed from the customary stream during conversion into a rod-like filler can be reused without any classification according to types of fibrous material.

A further object of the invention is to provide a simple and economical method of making cigarettes wherein the mouthpiece end of the filler contains tobacco shreds having a lower nicotine content and the major portion of the filler contains tobacco shreds with a higher nicotine content.

An additional object of the invention is to provide novel and improved machine for the practice of the above outlined method.

Still another object of the invention is to provide a machine which can be operated economically, wherein all of the fibrous material which is removed during conversion of a tobacco-containing stream into a rod-like filler can be reused, and which can be assembled of a relatively small number of simple parts.

A further object of the invention is to provide a machine which can produce a rod-like filler for the manufacture of rod-shaped smokers' products in such a way that tobacco shreds of one type form relatively short cylindrical batches or plugs which alternate with relatively long cylindrical portions consisting of tobacco shreds of another type.

One feature of the invention resides in the provision of a method of making rod-shaped smokers' products (especially cigarettes) of the type wherein the filler consists of first and second particulate fibrous materials, particularly of making smokers' products wherein the filler consists of two types of tobacco (preferably tobacco shreds having a relatively high nicotine content and tobacco shreds having a lower nicotine content). The method comprises the steps of feeding the first material into an elongated stream building zone so as to convert the first material into a continuous first stream which is transported lengthwise, feeding into the stream building zone discrete batches of second material at regular intervals to form a composite stream wherein one of the first and second materials overlies the other material in the region of each of the batches, and removing the first material from each such region to thereby convert the composite stream into a filler wherein the batches alternate with rod-like filler portions consisting of the first material. The length of filler portions between neighboring batches may equal or approximate the combined length of tobacco-containing portions of two filter cigarettes, cigars or cigarillos.

The second feeding step may precede the first feeding step, i.e., the first stream can overlie the batches whereby the first material which accumulates on the batches protrudes from the composite stream so that it can be readily removed by resorting to a suitable trimming or equalizing device. Alternatively, the first feeding step may precede the second feeding step so that the batches overlie the first stream; in such instance, the method preferably further comprises the step of moving the batches transversely of and into the first stream prior to the removing step so that the first material projects from the composite stream in the region of each batch and can be readily removed by the equalizing device.

The method further comprises the step of confining the filler in a web of cigarette paper or other suitable wrapping material so as to convert the web and the filler into a continuous rod wherein the web forms a tubular wrapper around the filler, and severing the rod across or adjacent to the batches. If the rod is severed midway across the batches, it is preferably also severed midway between neighboring batches so that each of the thus obtained sections of the rod comprises an elongated first portion containing first material and a relatively short second portion containing second material and preferably performing the function of the filter mouthpiece in a filter cigarette.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
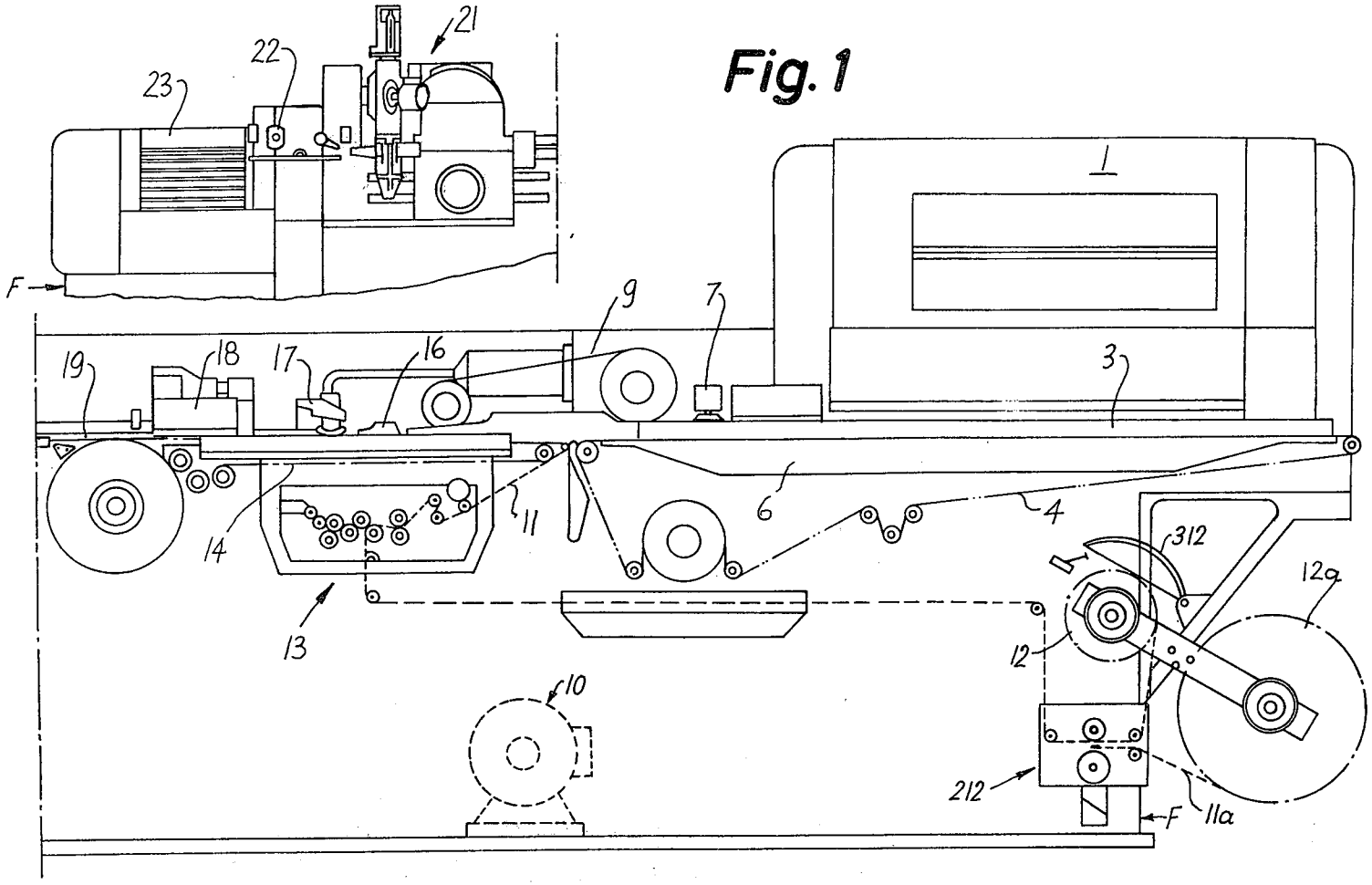
FIG. 1 is a schematic elevational view of a cigarette rod making machine having a distributor which embodies one form of the invention.
Figure 2:
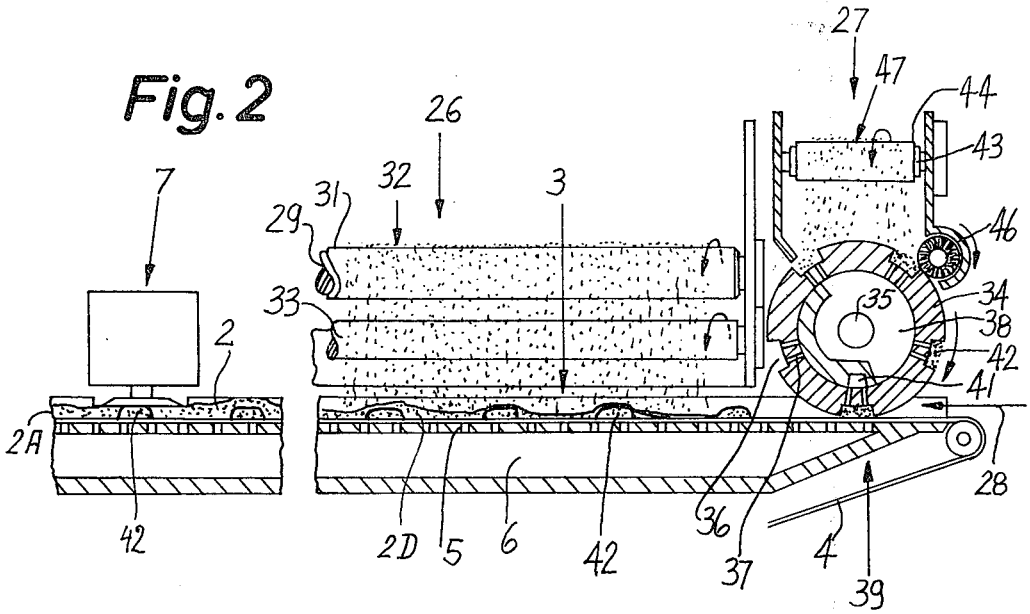
FIG. 2 is an enlarged fragmentary longitudinal vertical sectional view of the distributor and of certain other parts in the machine of FIG. 1.

FIG. 1 shows a high-speed cigarette rod making machine which comprises a frame F supporting novel distributor 1 which showers tobacco shreds into a narrow, elongated horizontal or substantially horizontal channel 3 wherein the shreds form a composite tobacco stream 2 (see FIG. 2). The bottom wall of the channel 3 is the upper reach of a foraminous band conveyor 4 which transports tobacco in a direction to the left, as viewed in FIG. 1, and is driven by the main prime mover 10 (e.g., a variable-speed electric motor) of the machine. The upper reach of the band conveyor 4 travels above the top wall of a stationary suction chamber 6 which is connected to a fan or another suitable suction generating device, not shown. The top wall of the suction chamber 6 has apertures 5 (see FIG. 2).

The composite tobacco stream 2 travels beyond the distributor 1 and its upper side is equalized by a trimming device 7 serving to remove the surplus so that the trimmed composite stream constitutes a rod-like tobacco filler 2A. The filler 2A is transferred onto a cigarette paper web 11 which is moved lengthwise by the upper reach of a garniture 14. The means for transferring the filler 2A from the upper reach of the band conveyor 4 onto the web 11 on the garniture 14 comprises an endless band conveyor 9 which preferably consists of metallic material and is formed with perforations. The lower reach of the conveyor 9 travels below the open or partially open underside of a suction chamber so that the conveyor 9 attracts the filler 2A during transfer onto the web 11. The latter is withdrawn from a roll 12 and passes through a splicing device 212 as well as through an imprinting device 13 which latter applies to spaced-apart portions of the web the trademark and/or the name of the manufacturer, the brand name of the cigarette and/or other indicia. The diameter of the roll 12 is monitored by a detector 312 which can actuate the splicing device 212 when the supply of web 11 is reduced to a predetermined minimum value. A fresh roll 12*a* is mounted adjacent to the expiring roll 12, and the leader of the web 11*a* of the roll 12*a* is threaded into the splicing device 212. When the detector 312 transmits a signal, the device 212 attaches the leader of the fresh web 11*a* to the running web 11 and severs the running web behind the thus obtained splice. The roll 12 is thereupon removed, the roll 12*a* moved into the range of the detector 312, and a fresh roll is mounted in the frame F to take the place of the roll 12*a*.

The garniture 14 is driven by the prime mover 10, the same as the band conveyor 9, and its upper reach transports the web 11 and the filler 2A through a wrapping mechanism 16 which drapes the web around the filler in such a way that one marginal portion of the web extends tangentially of the filler. Such marginal portion is coated with adhesive by the wheel-shaped applicator of a paster 17 and is thereupon folded over the other marginal portion to form a seam which extends longitudinally of the resulting wrapped filler rod or cigarette rod 19. The seam is heated by a sealer 18 to promote the setting of adhesive. The rod 19 moves through a severing device 21 of the type known as cutoff which subdivides the rod into a file of cigarettes. Successive cigarettes of the file are accelerated by a rotary cam 22 which propels them into successive flutes of a drum-shaped rotary conveyor 23 serving as a means for converting the single file of discrete cigarettes into one or more rows wherein the cigarettes travel sideways. Such row or rows are transported to storage, to a tray filling apparatus or directly to a packing machine, not shown.

The details of the improved distributor 1 are shown in FIG. 2. This distributor comprises a first tobacco feeding unit 26 and a second tobacco feeding unit 27 which latter is located upstream of the unit 26, as considered in the direction of travel of the upper reach of the band conveyor 4. The feeding unit 26 comprises a magazine (not shown) for a supply of a first type of tobacco shreds and a suitable mechanism for removing tobacco shreds from the magazine and for converting the withdrawn tobacco shreds into a continuous and relatively wide carpet or layer 32 which is transported toward the observer of FIG. 2 by a belt conveyor 31. The discharge end of the conveyor 31 is trained over a roller 29 which is parallel to and is located at a level above the left-hand portion of the channel 3, as viewed in FIG. 2. The manner in which the layer 32 is formed on the upper reach of the conveyor 31 is disclosed, for example, in the German Offenlegungsschrift No. 2,203,454 or in the commonly owned copending application Ser. No. 536,302 of Alfred Hinzmann, filed Dec. 24, 1974. The discharge end of the conveyor 31 showers the leading edge of the layer 32 onto a rapidly rotating cylindrical brush 33 which propels the shreds into the adjacent portion of the channel 3 so that the shreds accumulate on the upper reach of the conveyor 4 and form a continuous first stream 2D. The brush 33 is preferably driven at a constant speed.

The second feeding unit 27 also comprises a magazine for a supply of a second type of tobacco shreds and a mechanism which withdraws tobacco shreds from the magazine and converts the withdrawn tobacco shreds into a relatively wide layer or carpet 47 which is transported toward the observer of FIG. 2 by a belt conveyor 44. The discharge end of the conveyor 44 is trained over a horizontal roller 43 located at a level above the right-hand portion of the band conveyor 4, as viewed in FIG. 2. As shown, the conveyor 44 may be narrower than the conveyor 31. The discharge end of the conveyor 44 showers tobacco shreds of the second type onto a rotary conveyor here shown as a suction wheel 34 which is driven by a shaft 35 to rotate clockwise, as viewed in FIG. 2, and has a set of equally spaced-apart peripheral pockets or recesses 36 serving to accumulate batches 42 of tobacco shreds during travel below the discharge end of the conveyor 44. The suction wheel 34 surrounds a stationary suction chamber 38 which is connected with a suction generating device (e.g., with the device which draws air from the suction chamber 6). The wheel 34 has radially extending ports 37 which connect the pockets 36 with the suction chamber 38 while the pockets travel below the roller 43 and toward a transfer station 39 where the batches 42 are deposited onto the upper reach of the band conveyor 4. The transfer station 39 is located directly below a plenum chamber 42 which is connected with a source of compressed air and with which the ports 37 communicate during travel past the station 39 so that streamlets of air issuing from the chamber 41 promote the evacuation of batches 42 from the respective pockets 36 and the deposition of evacuated batches on the upper reach of the conveyor 4. The pressure in the chamber 41 need not appreciably exceed atmospheric pressure; in fact, it might be sufficient to simply connect the chamber 41 to the atmosphere, especially if (as shown in FIG. 2) the suction chamber 6 extends all the way to the transfer station 39. The second feeding unit 27 further comprises a rotary refuser 46, e.g., a rapidly rotating brush, which serves to equalize the batches 42 and to return the removed surplus of tobacco shreds of the second type into the space below the discharge end of the conveyor 44. The axis of the shaft 35 is normal to the direction (arrow 28) of lengthwise movement of the upper reach of the band conveyor 4 and to the axis of the roller 43. The peripheral speed of the suction wheel 34 equals the speed of the conveyor 4. The latter is driven in synchronism with the knife or knives of the cutoff 21.

The dimensions of the pockets 36 (as compared with the dimensions of other parts of the cigarette rod making machine) are exaggerated in FIG. 2 for the sake of clarity. The exaggeration is especially pronounced as considered in the circumferential direction of the suction wheel 34. In actual practice, the distance between neighboring pockets 36 of the suction wheel 34 equals the combined length of two plain cigarettes of unit length. Otherwise stated, the length of each pocket 36 (as considered in the circumferential direction of the suction wheel 34) may equal or approximate twice the length of the mouthpiece of a filter cigarette of unit length and the distance between neighboring pockets 36 may equal or approximate twice the length of the tobacco-containing portion or section of a filter cigarette of unit length. For example, the length of the pockets 36, as considered in the circumferential direction of the suction wheel 34, may equal 2D wherein D is the diameter of the rod 19, and the depth of a pocket 36 (as measured radially of the wheel 24) may equal D or the height of the rod-like filler 2A.

The operation is as follows:

The discharge end of the conveyor 44 showers the leading edge of the layer 47 onto the rotating suction wheel 34 whereby tobacco shreds of the second type enter and fill the pockets 36 to form unequalized batches 42. Such batches are equalized by the refuser 46 and the equalized batches 42 are retained in the respective pockets 36 by suction during travel toward the transfer station 39. When a batch 42 reaches the station 39, it is expelled from the respective pocket 36 by gravity, by streamlets of air issuing from the plenum chamber 41 and/or by streamlets of air flowing through the band conveyor 4 and into the adjacent portion of the suction chamber 6. Thus, those portions of the upper reach of the conveyor 4 which move from the transfer station 39 toward the trimming device 7 carry spaced-apart equalized batches 42 consisting of tobacco shreds of the second type. As the batches 42 advance beyond the suction wheel 34, they are covered by tobacco shreds of the first type. Such shreds are propelled into the channel 3 by the bristles of the brush 33 so that the shreds of the first type form a growing tobacco stream 2D having pronounced protuberances or bulges in the regions where the stream 2D overlies the batches 42. The brush 33 propels tobacco shreds which are showered by the discharge end of the conveyor 31.

The thus obtained composite tobacco stream 2 (which contains surplus consisting of tobacco shreds of the first type, at least in regions above the batches 42) is thereupon equalized by the trimming device 7 which removes the surplus and thus converts the composite stream 2 into a rod-like filler 2A wherein the batches 42 (no more overlapped by shreds of the first type) alternate with elongated filler portions consisting of tobacco of the first type. In other words, the filler 2A consists of alternating portions or sections which respectively contain shreds of the first and second type and wherein such portions or sections are disposed end-to-end. The quantity of tobacco in the equalized batches 42 can be readily selected in such a way that the trimming device 7 removes only (or practically exclusively) tobacco shreds of the first type so that the two types of tobacco shreds do not mix in the region of the trimming device 7 and the removed surplus can be returned into the magazine of the first feeding unit 26.

The filler 2A is thereupon draped into the web 11 to form the rod 19 which is severed by the cutoff 21 midway between as well as midway across successive batches 42 so that each cigarette which enters a flute of the conveyor 23 has a rod-like filler the major portion of which is composed of tobacco shreds of the first type and the remaining portion (analogous to the mouthpiece of a filter cigarette) is composed of tobacco shreds of the second type. If desired, the cutoff 21 can sever the rod 19 only behind or only in front of successive batches 42, for example, if the machine is to turn out relatively long cigarettes or if each cigarette is to have a relatively long filler portion consisting of tobacco shreds of the second type.

An important difference between the machine of FIGS. 1–2 and the previously discussed prior art machine is in the positioning of feeding units and trimming device with respect to each other. Such difference (the trimming device is located downstream of both feeding units) renders it possible to produce a superior filler wherein cylindrical portions consisting of tobacco shreds of the first type alternate with cylindrical portions or batches consisting of tobacco shreds of the second type. In accordance with the method of the present invention, tobacco shreds of the first type necessarily extend laterally of the stream 2 beyond the upper side of the stream wherever they overlie the batches 42 so that they can be readily removed by the trimming device.

Figure 3:
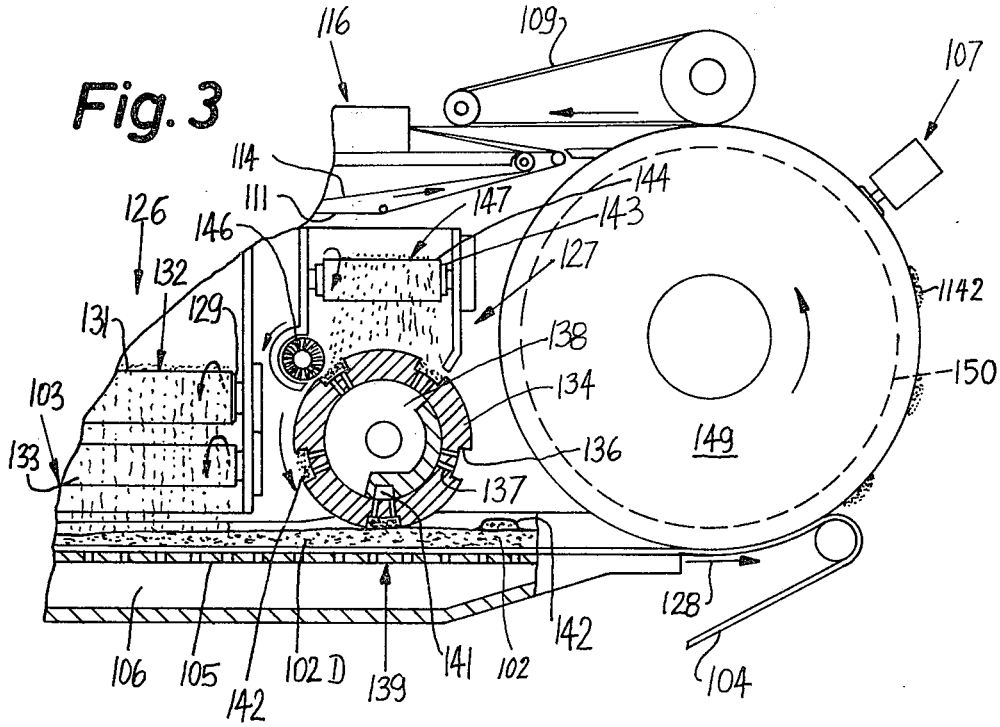
FIG. 3 is a similar fragmentary longitudinal vertical sectional view of a modified machine.

FIG. 3 shows a portion of a second high-speed cigarette rod making machine similar to a machine known as GARANT (trademark) produced by the assignee of the present application. All such parts of the second machine which are identical with or analogous to the corresponding parts of the first machine are denoted by similar reference characters plus 100. One of the main differences between the two machines is that the tobacco channel 103 of FIG. 3 is located at a level below the wrapping mechanism 116 and that the trimming device 107 is adjacent to the periphery of a relatively large intermediate conveyor here shown as a suction wheel 149 having a circumferential groove 150. The wheel 149 surrounds a stationary suction chamber and the bottom wall of the groove 150 is foraminous so that tobacco which enters the groove 150 at the six o'clock position of the wheel 149 is attracted to the bottom wall by suction while travelling with the wheel 149 toward the lower reach of the transfer conveyor 109. The purpose of the suction wheel 149 is to transport the tobacco stream 102 from the level immediately above the upper reach of the band conveyor 104 to the level of the upper reach of the garniture 114 and to thereby advance the stream 102 past the trimming device 107. The conveyor 109 is a foraminous steel belt the lower reach of which travels below the open or partly open underside of a stationary suction chamber so that the conveyor 109 withdraws the rod-like tobacco filler from the groove 150 and advances it toward and onto the cigarette paper web 111 on the garniture 114. The manner in which the filler and the web 111 are converted into a continuous rod and the rod is converted into a single file of cigarettes is the same as described in connection with FIG. 1.

Another difference between the first and second machines is that the second feeding unit 127 of the second machine is located downstream of the first feeding unit 126, as considered in the direction indicated by arrow 128. The first feeding unit 126 builds on the upper reach of the conveyor 104 a continuous stream 102D consisting of tobacco shreds of the first type. This stream is free of protuberances because each of its increments lies directly on the band conveyor 104. The second feeding unit 127 deposits equalized batches 142 of tobacco shreds of the second type on top of the continuous (but unequalized) stream 102D advancing beyond the right-hand axial end of the brush 133. Successive increments of the thus obtained composite stream 102 thereupon enter the groove 150 whereby the stream 102 exhibits protuberances 1142 in regions where tobacco shreds of the first type overlie the batches 142. Thus, the trimming device 107 removes a surplus which consists of tobacco shreds of the first type, and such surplus can be returned into the magazine of the feeding unit 126 because it does not contain any shreds of the second type. The formation of protuberances 1142 is due to the fact that the batches 142 in the groove 150 cause the adjacent portions of the continuous stream 102D (tobacco shreds of the first type) to move radially outwardly of the suction wheel 149 so that they can be removed by the rotary cutter or cutters of the trimming device 107. In other words, the batches 142 move into the stream 102D and displace the corresponding portions of the stream 102D radially outwardly of the wheel 149 or transversely of the stream 102.

An important advantage of the improved machine is that it constitutes a relatively minor modification of presently known high-speed cigarette rod making machines. Thus, and if the first feeding unit 26 or 126 is considered a functional equivalent of a conventional distributor, it is only necessary to add the second feeding unit 27 or 127 (either upstream or downstream of the first feeding unit) in order to enable the machine to produce cigarettes or analogous rod-shaped smokers' products with composite fillers. Moreover, the improved machine renders it possible to maintain a distinct line of demarcation between tobacco shreds of the first and second type, and the machine also allows for immediate transport of removed surplus into the magazine of the first feeding unit because the trimming device removes only tobacco shreds of the first type. As a rule, the nicotine content of tobacco shreds of the second type will be lower so that the batches 42 or 142 may constitute equivalents of conventional filter plugs. It is also possible to utilize the second unit 27 or 127 to feed a particulate fibrous or like material which is a substitute for tobacco, which consists of reconstituted tobacco, or which constitutes a filtering substance for tobacco smoke. The feature that filler portions of tobacco shreds of the first type alternate or are disposed end-to-end with filler portions of the second type further insures that the smoker is less likely to inhale smoke which would develop on combustion of the second type of tobacco shreds. In order to insure that the smoker will invariably light that end which contains tobacco shreds of the first type, the web 11 or 111 may include differently colored portions for the respective portions of the fillers.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims:

1. In a method of making rod-like smokers' products of the type wherein the filler consists of first and second particulate fibrous materials, particularly of making smokers' products wherein the filler consists of two types of tobacco, the steps of feeding said first material into an elongated stream building zone so as to convert said first material into a continuous first stream; feeding into said zone discrete batches of said second material at regular intervals to form a composite stream wherein one of said materials overlies the other of said materials in the region of each of said batches; and removing said first material from each of said regions to thereby convert said composite stream into a filler wherein said batches alternate with filler portions consisting of said first material.

2. In a method as defined in claim 1, wherein said second feeding step precedes said first feeding step so that said first material overlies said batches.

3. In a method as defined in claim 1, wherein said first feeding step precedes said second feeding step so that said batches overlie said first material.

4. In a method as defined in claim 3, the additional step of moving said batches transversely of and into said first stream prior to said removing step so that said first material projects from said composite stream in each of said regions.

5. In a method as defined in claim 1, the additional steps of confining said filler in a web of wrapping material so as to convert said web and said filler into a continuous rod wherein said web forms a tubular wrapper around said filler, and severing said rod across or adjacent to said batches.

6. In a method as defined in claim 5, wherein said severing step comprises cutting said rod midway across successive batches, the length of said filler portions between neighboring batches of said filler being equal to or approximating the combined length of tobacco-containing portions of two filter cigarettes.

7. A method as defined in claim 1, wherein said first material is shredded tobacco having a relatively high nicotine content and said second material is shredded tobacco having a relatively low nicotine content.

8. In a machine for making rod-like smokers' products of the type wherein the filler consists of first and second particulate fibrous materials, particularly for making smokers' products wherein the filler consists of two types of tobacco, a combination comprising conveyor means; means for continuously feeding said first material onto said conveyor means so that the first material thus fed forms a continuous first stream which moves lengthwise in a predetermined direction; means for feeding onto said conveyor means discrete batches of said second material at regular intervals so that said batches and said first stream form a composite stream wherein one of said materials overlies the other of said materials in the region of each of said batches; and means for removing said first material in each of said regions to thereby convert said composite stream into a filler wherein said batches alternate with filler portions consisting of said first material.

9. A combination as defined in claim 8, wherein said removing means comprises a trimming device.

10. A combination as defined in claim 9, wherein said trimming device is located downstream of said feeding means, as considered in said direction, and said first mentioned feeding means is located intermediate said trimming device and said last mentioned feeding means so that said first stream overlies said batches.

11. A combination as defined in claim 10, wherein said composite stream has a first side adjacent to said conveyor means and a second side opposite said first side, said trimming device being adjacent to said second side.

12. A combination as defined in claim 9, wherein said trimming device is located downstream of said feeding means, as considered in said direction, and said last mentioned feeding means is located intermediate said trimming device and said first mentioned feeding means so that said batches overlie said first stream, said conveyor means comprising an intermediate conveyor arranged to invert said composite stream so that said first stream overlies said batches intermediate said last mentioned feeding means and said trimming device.

13. A combination as defined in claim 8, wherein said first mentioned feeding means comprises an endless belt conveyor for a layer of said first material.

14. A combination as defined in claim 8, wherein said last mentioned feeding means comprises a rotary conveyor having a peripheral surface provided with recesses and means for supplying said second material into said recesses whereby the material filling a recess constitutes one of said batches.

15. A combination as defined in claim 8, further comprising means for draping a web of wrapping material around said filler so that said web and said filler form a continuous rod, and means for severing said rod adjacent to or across said batches.

16. A combination as defined in claim 15, wherein said severing means comprises a cutoff and said last mentioned feeding means comprises a rotary conveyor arranged to deliver said batches to said conveyor means, and further comprising means for rotating said rotary conveyor in synchronism with the operation of said cutoff.

17. A combination as defined in claim 8, wherein the length of said portions of said filler equals or approximates the combined length of tobacco-containing portions of two filter cigarettes.

18. A combination as defined in claim 8, wherein said conveyor means comprises at least one suction conveyor and said last mentioned feeding means comprises a rotary suction wheel.

* * * * *